US010743108B2

(12) United States Patent
Xiao et al.

(10) Patent No.: US 10,743,108 B2
(45) Date of Patent: Aug. 11, 2020

(54) MINIATURE SPEAKER

(71) Applicant: AAC Technologies Pte. Ltd., Singapore (SG)

(72) Inventors: Bo Xiao, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/236,332

(22) Filed: Dec. 28, 2018

(65) Prior Publication Data

US 2019/0208325 A1 Jul. 4, 2019

(30) Foreign Application Priority Data

Jan. 4, 2018 (CN) ..... 2018 1 0006477

(51) Int. Cl.

| | |
|---|---|
| ***H04R 7/02*** | (2006.01) |
| ***H04R 9/02*** | (2006.01) |
| ***H04R 1/02*** | (2006.01) |
| ***H04R 9/06*** | (2006.01) |
| ***H04R 7/12*** | (2006.01) |
| ***H04R 7/20*** | (2006.01) |

(52) U.S. Cl.

CPC ..... *H04R 7/02* (2013.01); *H04R 1/02* (2013.01); *H04R 7/122* (2013.01); *H04R 7/20* (2013.01); *H04R 9/02* (2013.01); *H04R 9/025* (2013.01); *H04R 9/06* (2013.01); *H04R 2307/201* (2013.01); *H04R 2400/11* (2013.01); *H04R 2499/11* (2013.01)

(58) Field of Classification Search

CPC ..... H04R 7/122; H04R 7/125; H04R 7/20; H04R 1/02; H04R 9/02; H04R 9/06; H04R 9/025; H04R 2499/11; H04R 2307/201

See application file for complete search history.

(56) References Cited

U.S. PATENT DOCUMENTS

2014/0153771 A1* 6/2014 Ohashi ..... H04R 9/06 381/412
2015/0189442 A1* 7/2015 Zhang ..... H04R 9/025 381/409

FOREIGN PATENT DOCUMENTS

CN 201657289 B1 11/2010
CN 107277706 A1 10/2017

* cited by examiner

*Primary Examiner* — Sunita Joshi
(74) *Attorney, Agent, or Firm* — IPro, PLLC; Na Xu

(57) ABSTRACT

The present application discloses a miniature speaker, including: a frame; a vibration system positioned on the frame; a magnetic circuit system for driving the vibration system. The vibration system includes a first diaphragm fixed to the frame, a second diaphragm, and a voice coil for driving the first diaphragm to produce sounds. The second diaphragm includes a suspension, a first fastening portion fixed to the frame, a second fastening portion fixed to the voice coil at an end away from the first diaphragm. The suspension includes a main suspension and a pair of auxiliary suspensions extending from two edges of the main suspension along a length direction of the main suspension. A width of the main suspension is greater than a width of the auxiliary suspension. The rigidity of the second suspension is improved, and the lateral swing of the vibration system is suppressed.

8 Claims, 2 Drawing Sheets

MINIATURE SPEAKER

FIELD OF THE PRESENT DISCLOSURE

The present disclosure relates to the field of electroacoustic components, and more particularly to a miniature speaker used in a portable electronic device.

DESCRIPTION OF RELATED ART

With the development of mobile internet, smart devices are widely used by population. A smart mobile phone is the most important one of these devices. A component that can reproduce audible sounds (music) is widely used in the mobile phone. Such a component is called miniature speaker. For satisfying the demands of high-quality sound, miniature, stereo-sound, the miniature speaker is focused by the designers. A vibration system and a magnetic circuit system directly affect the sound quality of a miniature speaker.

For enhancing the stability of the vibration system, a typical vibration system includes a first diaphragm fastened to a frame for radiating sounds, a voice coil attached to the first diaphragm, and a second diaphragm for improving the longitudinal balance of the voice coil. The magnetic circuit system includes a yoke and a magnet carried by the yoke.

The second diaphragm includes a suspension, a first fastening portion and a second fastening portion extending respectively from two sides of the suspension. The first fastening portion is used for being fixed to the frame and the second fastening portion is used for being attached to an end of the voice coil away from the first diaphragm.

In the related art, the suspension of the second diaphragm has an even width, which limits the rigidity of the second diaphragm.

Therefore, it is desired that an improved miniature speaker can overcome the disadvantages mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

Figure 1:
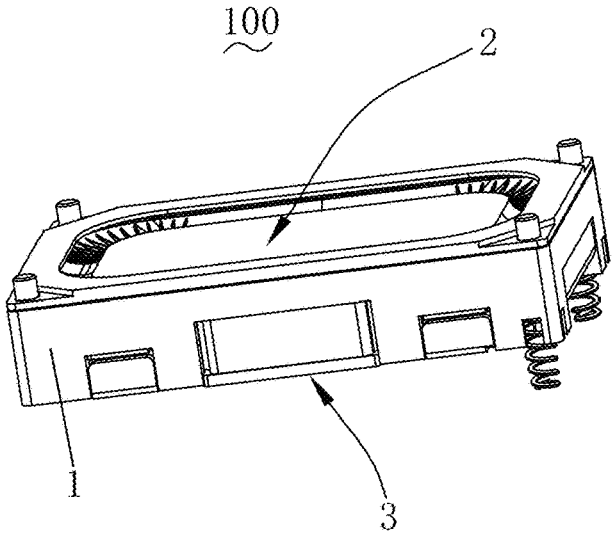
FIG. 1 is an isometric view of a miniature speaker in accordance with an exemplary embodiment of the present invention.
Figure 2:
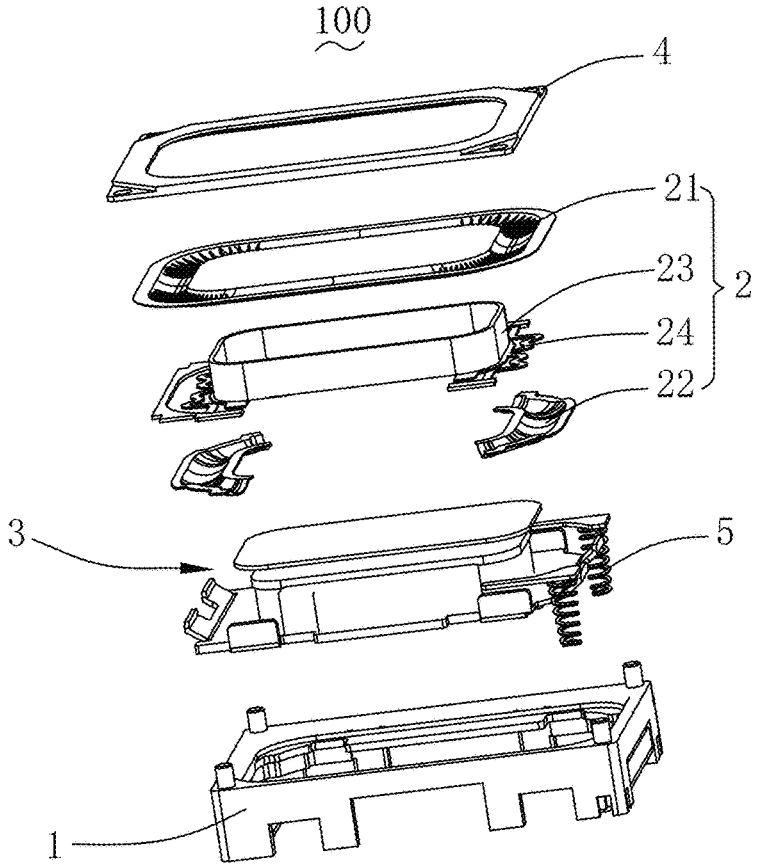
FIG. 2 is an isometric and exploded view of the miniature speaker in FIG. 1.

Referring to FIGS. 1-2, a miniature speaker 100, in accordance with an exemplary embodiment, includes a frame 1, a vibration system 2 positioned by the frame 1 and a magnetic circuit system 3 supported by the frame 1. The magnetic circuit system 3 is used for driving the vibration system 2 to produce sounds.

The vibration system 2 includes a first diaphragm 21, a second diaphragm 22, a voice coil 23 and an elastic member 24.

The first diaphragm 21 is fixed to the frame 1 by a front cover 4. The voice coil 23 has one end fastened to the first diaphragm 21 for driving the first diaphragm 21 to vibrate. The second diaphragm 22 is also fastened to the frame 1 and is attached to another end of the voice coil 23. The second diaphragm 22 is used for enhance the vibration of the first diaphragm 21, and further for balancing the swing of the vibration system 2.

Figure 3:
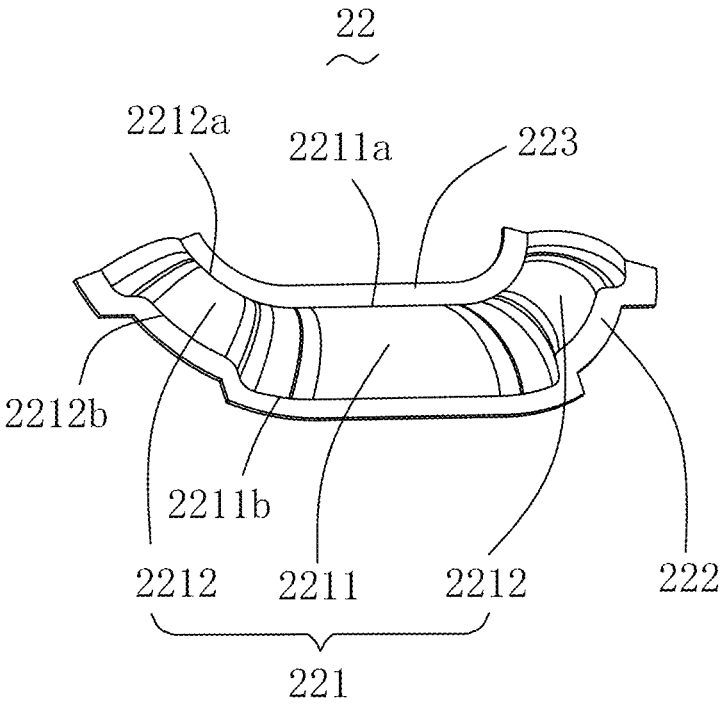
FIG. 3 is an isometric view of a second diaphragm of the miniature speaker.

Referring to FIG. 3, the second diaphragm 22 includes a suspension 221, a first fastening portion 222 extending from one end of the suspension 221, and a second fastening portion 223 extending from another end of the suspension 221.

The first fastening portion 222 is fixed to the frame 1, and the second fastening portion 223 is fastened to the voice coil 23 at one end of the voice coil away from the first diaphragm 21, by which the voice coil 23 is connected to the frame 1, and the vibration efficiency of the first diaphragm 21 is improved. Accordingly, sound quality of the miniature speaker 100 is improved. In addition, the lateral rigidity of the vibration system 2 is enhanced, which balances the vibration of the vibration system 2, and further improves the stability of the miniature speaker 100.

In this embodiment, the suspension 221 includes a main suspension 2211 and a pair of auxiliary suspensions 2212 extending from the main suspension 2211 along a length direction of the main suspension 2211. A width of the main suspension 2211 is greater than a width of the auxiliary suspension 2212. Other words, a cross-sectional view of the main suspension 2211 has a longer arc length than that of the auxiliary suspension 2212. By the virtue of this configuration, the rigidity of the second suspension 22 is improved, and the lateral swing of the vibration system 2 is suppressed.

Referring to FIG. 3, the main suspension 2211 includes a first inner side 2211*a* and an outer side 2211*b* opposite to the inner side 2211*a*. The auxiliary suspension 2212 includes a second inner side 2212*a* connected with the first inner side 2211*a* and a second outer side 2212*b* connected with the first outer side 2211*b*. The second inner side 2212*a* is opposite to the second outer side 2212*b*. A distance from the outer side 2211*b* to the voice coil 23 is greater than a distance from the second outer side 2212*b* to the voice coil 23. An inner edge of the suspension is parallel to the voice coil, therefore, a distance from the first inner side 2211*a* to the voice coil 12 is equal to a distance from the second inner side 2212*a* to the voice coil 23.

The auxiliary suspension 2212 of the suspension 221 avoids impact between the first diaphragm 21 and the frame 1 and further avoids noises.

In the embodiment, the two auxiliary suspensions 2212 are symmetrical about the main suspension 2211. And preferably, the suspension 221 includes two pieces symmetrical about the magnetic circuit system 3.

In the embodiment, the frame 1 is substantially rectangular, and the two suspensions 221 are arranged along two short sides of the frame 1, which ensures the volume of the magnetic circuit system 3.

The main suspension 2211 is fixed to the short side of the frame 1, and the auxiliary suspensions are fixed to corners of the frame 1. The width of the auxiliary suspension 2212 is smaller than that of the main suspension 2211.

The elastic member 24 cooperates with the second diaphragm 22, with one end thereof fixed to the frame 1 and another end fixed to the voice coil 23 away from the first diaphragm 21. The smaller width of the auxiliary suspension 2212 provides more space to design other component, like the elastic member 24.

The second diaphragm 22 is attached to the elastic member 24 at the side away from the first diaphragm 21 for further improving the lateral rigidity of the second diaphragm 22. In fact, according to actual requirements, the elastic member 24 can be a conductive member for providing electrical signals to the voice coil 23. As an option, the elastic member 24 is an FPC including an electrical portion out of the frame 1. The second outer side 2212*b* forms a positioning area together with the frame 1 for positioning the electrical portion.

The suspension 221 includes the main suspension 2211 and auxiliary suspensions 2212 extending from the main suspension 2211 along a length direction of the main suspension 2211. A width of the main suspension 2211 is greater than a width of the auxiliary suspension 2212. Other words, a cross-sectional view of the main suspension 2211 has a longer arc length than that of the auxiliary suspension 2212. By the virtue of this configuration, the rigidity of the second suspension 22 is improved, and the lateral swing of the vibration system 2 is suppressed.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature speaker, including:

a frame;

a vibration system positioned on the frame, the vibration system including a first diaphragm fixed to the frame, a second diaphragm, and a voice coil for driving the first diaphragm to produce sounds;

a magnetic circuit system for driving the vibration system; wherein the second diaphragm includes a suspension, a first fastening portion fixed to the frame, a second fastening portion fixed to the voice coil at an end away from the first diaphragm;

the suspension includes a main suspension and a pair of auxiliary suspensions extending from two edges of the main suspension along a length direction of the main suspension; and a width of the main suspension is greater than a width of the auxiliary suspension:

wherein the main suspension includes a first inner side and an outer side opposite to the inner side, the auxiliary suspension includes a second inner side connected with the first inner side and a second outer side connected with the first outer side; the second inner side is opposite to the second outer side; a distance from the outer side to the voice coil is greater than a distance from the second outer side to the voice coil.

2. The miniature speaker as described in claim 1, wherein a distance from the first inner side to the voice coil is equal to a distance from the second inner side to the voice coil.

3. The miniature speaker as described in claim 1, wherein the two auxiliary suspensions are symmetrical about the main suspension.

4. The miniature speaker as described in claim 3, wherein the suspension includes two pieces symmetrical about the magnetic circuit system.

5. The miniature speaker as described in claim 4, wherein the frame is substantially rectangular, and the two suspensions are arranged along two short sides of the frame.

6. The miniature speaker as described in claim 5, wherein the main suspension is fixed to the short side of the frame, and the auxiliary suspensions are fixed to corners of the frame.

7. The miniature speaker as described in claim 1 further including an elastic member cooperating with the second diaphragm, wherein the elastic member has one end thereof fixed to the frame and another end fixed to the voice coil away from the first diaphragm; the second diaphragm is attached to the elastic member at the side away from the first diaphragm.

8. The miniature speaker as described in claim 7, wherein the elastic member is an FPC including an electrical portion out of the frame, the second outer side forms a positioning area together with the frame for positioning the electrical portion.

* * * * *